US011473252B2

(12) United States Patent
Brand

(10) Patent No.: US 11,473,252 B2
(45) Date of Patent: Oct. 18, 2022

(54) PROTECTION SYSTEM FOR TENSION MEMBERS

(71) Applicant: DYWIDAG-SYSTEMS INTERNATIONAL GMBH, Munich (DE)

(72) Inventor: Werner Brand, Freising (DE)

(73) Assignee: DYWIDAG-SYSTEMS INTERNATIONAL GMBH, Munich (DE)

( * ) Notice: Subject to any disclaimer, the term of this patent is extended or adjusted under 35 U.S.C. 154(b) by 302 days.

(21) Appl. No.: 16/075,813

(22) PCT Filed: Jul. 12, 2018

(86) PCT No.: PCT/EP2018/068950

§ 371 (c)(1),
(2) Date: Aug. 6, 2018

(87) PCT Pub. No.: WO2019/076499

PCT Pub. Date: Apr. 25, 2019

(65) Prior Publication Data

US 2021/0207332 A1 Jul. 8, 2021

(30) Foreign Application Priority Data

Oct. 16, 2017 (DE) ..... 10 2017 218 479.5

(51) Int. Cl.
*E01D 19/16* (2006.01)

(52) U.S. Cl.
CPC ..... *E01D 19/16* (2013.01)

(58) Field of Classification Search
CPC ..... E01D 19/16; E01D 19/14; F16L 57/00; F16L 57/06
See application file for complete search history.

(56) References Cited

U.S. PATENT DOCUMENTS 4,612,680 A * 9/1986 Daiguji ..... E01D 19/16 174/92
4,796,670 A * 1/1989 Russell ..... E21B 17/105 138/108

(Continued)

FOREIGN PATENT DOCUMENTS

DE 617011 8/1935
DE 890355 9/1953

(Continued)

OTHER PUBLICATIONS

International Search Report filed in PCT/EP2018/068950 dated Oct. 30, 2018.

(Continued)

*Primary Examiner* — Abigail A Risic
(74) *Attorney, Agent, or Firm* — Rankin, Hill & Clark LLP

(57) ABSTRACT

A tension member protection system includes two or more shell elements arranged circumferentially around a tension member which together surround a cavity that receives the tension member. A plurality of joining sleeves, each of which is associated with one of the two shell elements, is designed and arranged on the shell elements in such a way that, in a cavity forming state, they interlock so that their through-holes in the longitudinal direction of the tension member protection system only overlap completely when the two shell elements lie with their contact surfaces against other. A rod-shaped element is designed to be passed through the through-holes of the interlocking joining sleeves.

15 Claims, 6 Drawing Sheets

(56) References Cited

U.S. PATENT DOCUMENTS

Figure 1:
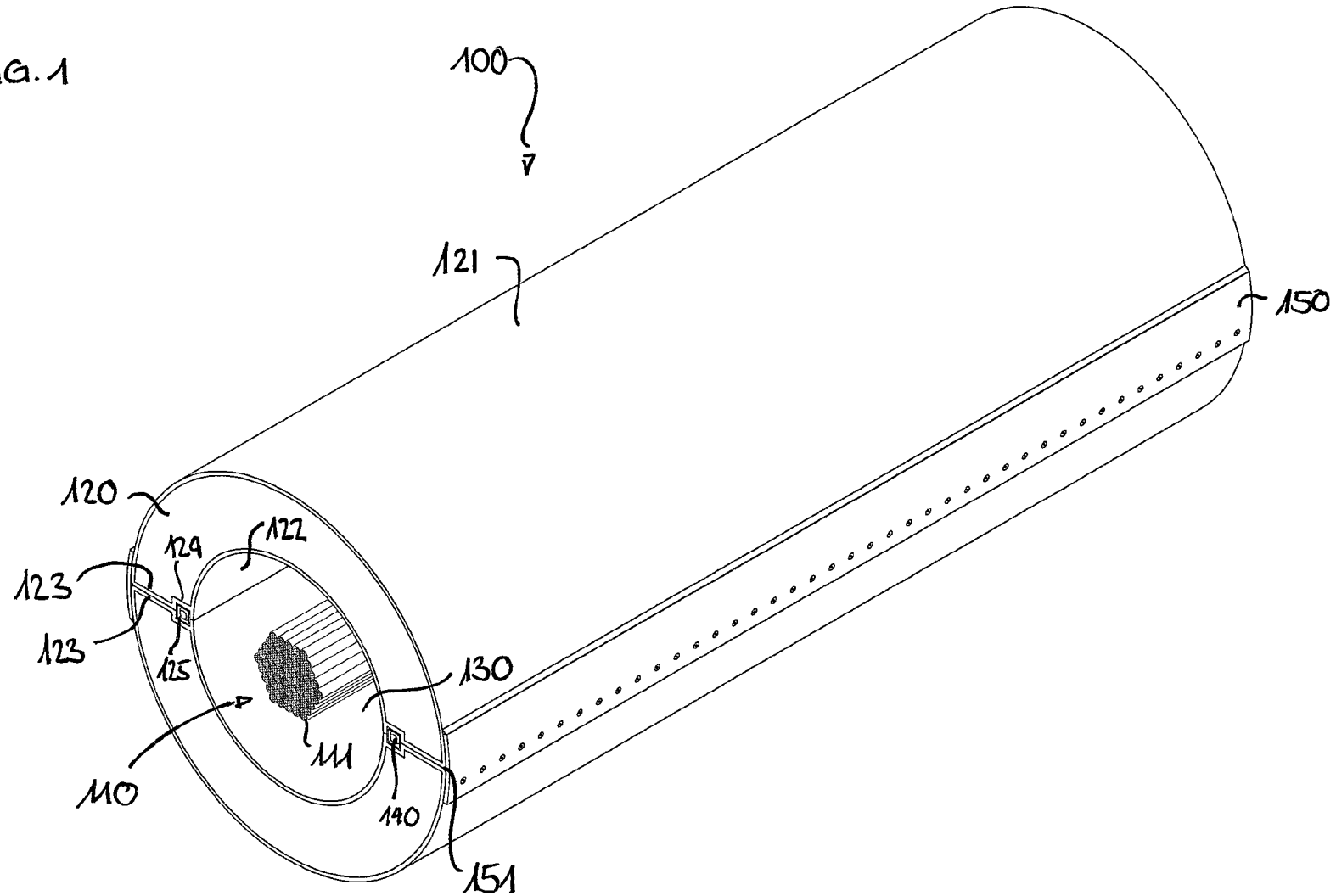

| | | | | |
|---|---|---|---|---|
| 6,431,216 | B1 * | 8/2002 | Briscoe | F16L 57/00 138/110 |
| 2006/0051035 | A1 * | 3/2006 | Cavill | E01D 19/16 385/100 |
| 2010/0314811 | A1 * | 12/2010 | Mellier | D07B 5/006 267/140.4 |
| 2010/0319522 | A1 | 12/2010 | Hallissy et al. | |
| 2011/0302856 | A1 | 12/2011 | Ebaugh et al. | |
| 2012/0058338 | A1 | 3/2012 | Fyfe | |
| 2021/0172116 | A1 * | 6/2021 | Aveline | E01D 19/16 |
| 2022/0064855 | A1 * | 3/2022 | Fabry | E01D 19/16 |

FOREIGN PATENT DOCUMENTS

| | | |
|---|---|---|
| DE | 2103904 | 8/1972 |
| DE | 4304602 | 8/1994 |
| EP | 0169276 | 1/1986 |
| EP | 0497460 | 8/1992 |
| EP | 0787938 | 8/1997 |
| FR | 1482629 | 5/1967 |
| FR | 2523564 | 9/1983 |

OTHER PUBLICATIONS

German Search Report filed in Application No. 10 2017 218 479.5 dated Jul. 27, 2018.

* cited by examiner

PROTECTION SYSTEM FOR TENSION MEMBERS

The invention concerns a protection system for tension members designed and intended to protect a tension member arranged between two sections of a structure, comprising two or more shell elements which can be arranged circumferentially around the tension member and which together surround a cavity intended to accommodate the tension member, and a joining means whereby the shell elements can be detachably connected to each other.

Such tension member protection systems are known in the prior art. They are generally used to protect the tension member from heat and/or fire and/or impact and/or mechanical damage and/or other events which may threaten its integrity, whether of natural or human origin.

A design consisting of two or more shell elements that can be arranged circumferentially around the tension member allows, on the one hand, the retrofitting of tension member protection systems on tension members of existing structures, such as cable-stayed bridges, and, on the other hand, the temporary removal of the tension member protection systems from the tension members, for example in order to carry out maintenance on the tension members.

From US 2011/0302856 A1, a tension member protection system of the same class is known, for the mounting of which on the tension member a plurality of brackets must first be attached, which are designed with hinges and with plates hingedly attached to the brackets. Shell elements protecting the tension member are then attached to these plates. A disadvantage of this design is that the circumferential sections in which the hinges are arranged are designed with reduced wall thickness to enable the shell elements to pivot, hence these form weak points of the aforementioned tension member protection system.

It is therefore the object of the invention to provide an improved tension member protection system.

This object is attained according to the invention by means of a tension member protection system of the type mentioned above, in which the joining means for joining at least two shell elements, which in the cavity-forming state lie with their two contact surfaces against each other, comprise a plurality of joining sleeves, each of which is assigned to one of the two shell elements, the joining sleeves being designed and arranged on the shell elements in such a way that, in the cavity-forming state, they interlock so that, viewed in the longitudinal direction of the tension member protection system, their through-holes only entirely overlap when the two shell elements lie with their contact surfaces against each other, and the joining means further comprise a rod-shaped element which is designed and intended to be passed through the through-holes of the interlocking joining sleeves.

Although the joining means according to the invention appear to be of hinge-like design due to the interaction of the joining sleeves and the rod-shaped element, they do not allow the two shell elements under consideration to swivel relative to each other. This is prevented by the fact that the rod-shaped element can only be passed through the through-holes of the interlocking joining sleeves when the two shell elements lie with their contact surfaces against each other. This design allows the tension member protection system to have the same radial extent in the circumferential section in which the joining means are arranged as in all other circumferential sections. The tension member protection system according to the invention therefore has no weak points.

In order to prevent moisture from penetrating into the joint between the two shell elements, it is proposed that a cover plate be provided which covers the joint between the two adjacent shell elements and is fastened to at least one of the two shell elements.

To conceal the circumferential position at which the joint is actually located, at least one further cover plate can also be provided which is fastened to the outer surface of one of the shell elements.

With the aim of achieving an effective joining of the two shell elements, it is proposed in a further development of the invention that the length of the rod-shaped element be essentially equal to the length of the tension member protection system. As a simple means of preventing the rod-shaped element from accidentally falling of its own accord out of the lower end of the tension member protection system in the assembled state, the tension member protection system can be provided with a base plate. It is furthermore advantageous, after the rod-shaped element has been inserted, to close the upper end of the tension member protection system in the assembled state with a cover plate to at least hinder, if not prevent access to the rod-shaped element.

If a plurality of tension member protection systems according to the invention are arranged in the longitudinal direction immediately adjacent to one another on a tension member, the rod-shaped element may also be of a length that is essentially equal to the length of the overall arrangement of tension member protection systems.

Effective interaction of the joining sleeves and the rod-shaped element can be achieved by the fact that the joining sleeves assigned to one shell element and the joining sleeves assigned to the other shell element interlock in alternating sequence. It is also advantageous if the joining sleeves assigned to the two shell elements are of the same length. Only the end joining sleeves in the longitudinal direction of the tension member can be of a different length.

To simplify production of the shell elements, it is proposed in a further development of the invention that the joining sleeves should have a rectangular, preferably square, cross-section. In this case, the joining sleeves can be provided as separate elements which can be fastened to the respective shell element or the housing of the respective shell element, for example by welding, soldering, gluing or another suitable fastening technique, after laying one of their rectangular or square sides against it.

The rod-shaped element may however have a circular cross-section. Such round rods can be obtained at reasonable cost.

Regardless of the cross-sectional shape of the joining sleeves and of the rod-shaped element, it is advantageous if the cross-section of the joining sleeves has internal dimensions which are larger than the external dimensions of the cross-section of the rod-shaped element. For example, it is advantageous if the diameter of a rod-shaped element with a circular cross-section is smaller than the side length of a square-shaped joining sleeve. This makes it possible to insert the rod-shaped element into the interlocking joining sleeves even if their passage openings do not overlap completely.

In order to protect the joining means effectively against external influences, it is proposed in a further development of the invention to arrange the joining sleeves in a radial section of the two shell elements adjoining the cavity, preferably directly adjacent to the cavity. This allows the actual protection system to extend radially outside the joining means, protecting not only the tension member but also the joining means.

In a further development of the invention, the joining sleeves can be arranged in the cavity. The connection means are preferably arranged with an intermediate web on an inner circumferential surface of the shell elements or can be arranged directly adjacent to the inner circumferential surface of the shell elements.

This arrangement protects the joining means even more effectively against external influences.

In a further embodiment of the invention, a coupling device can be arranged in the contact surfaces of at least two shell elements, which lie against each another in the cavity-forming state, which couples the contact surfaces of at least two shell elements with each other. This eliminates shear stresses between the contact surfaces.

In a further development of the invention, it is proposed that at least one shell element should have a housing, and preferably all shell elements should have a housing, whose interior accommodates the protection system. The housing can be made of sheet steel, for example.

Figure 2:
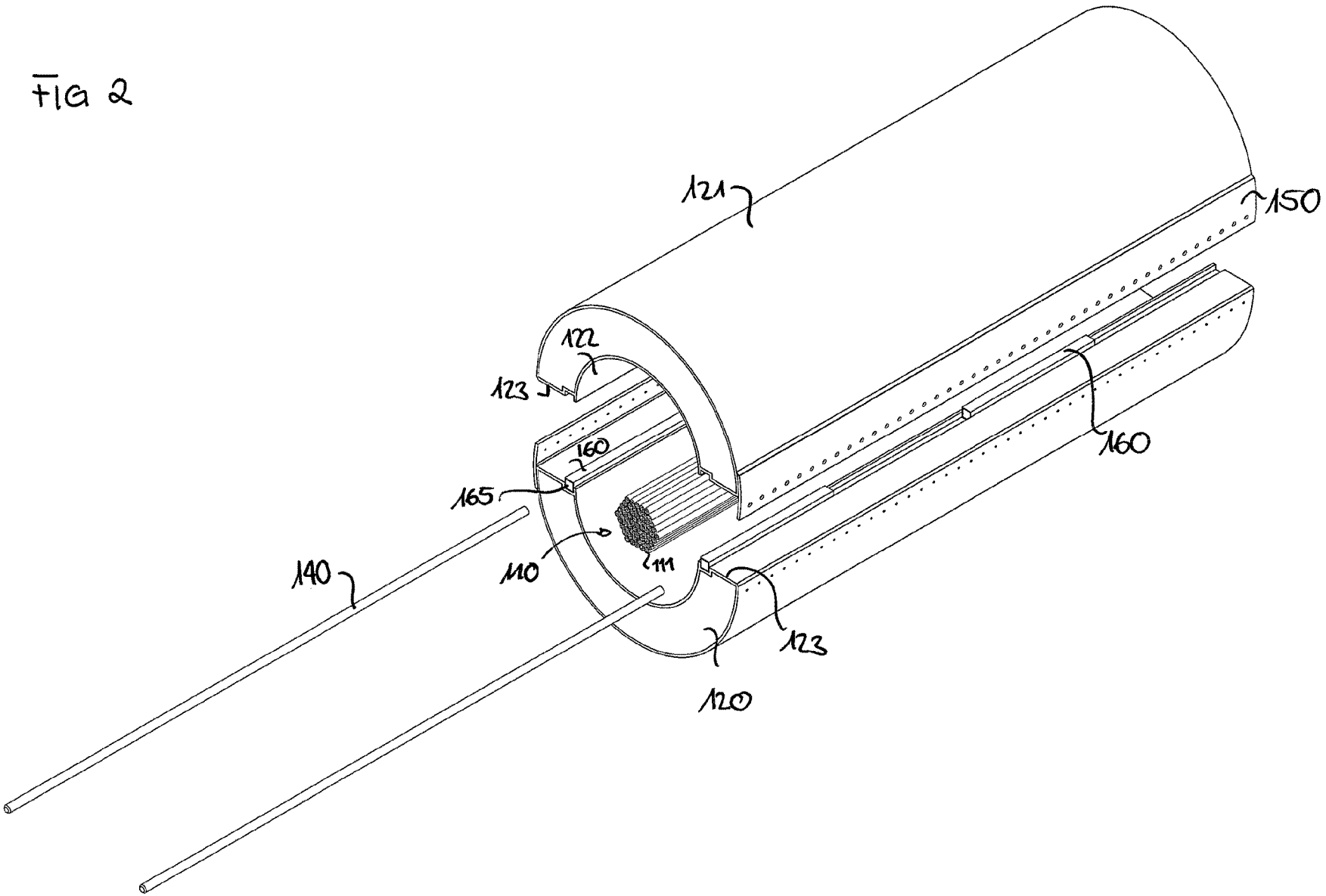
Figure 3:
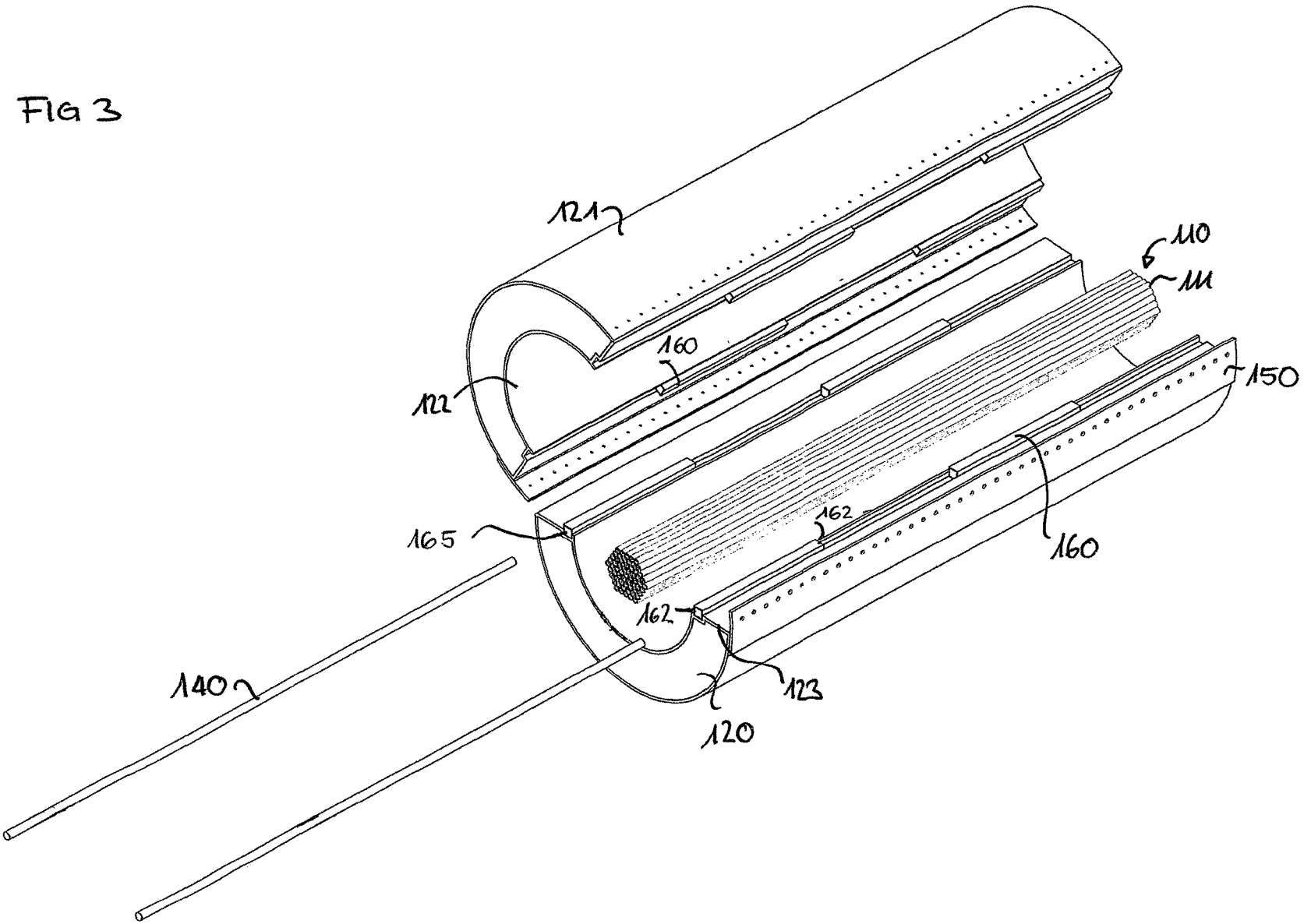
Figure 4B:
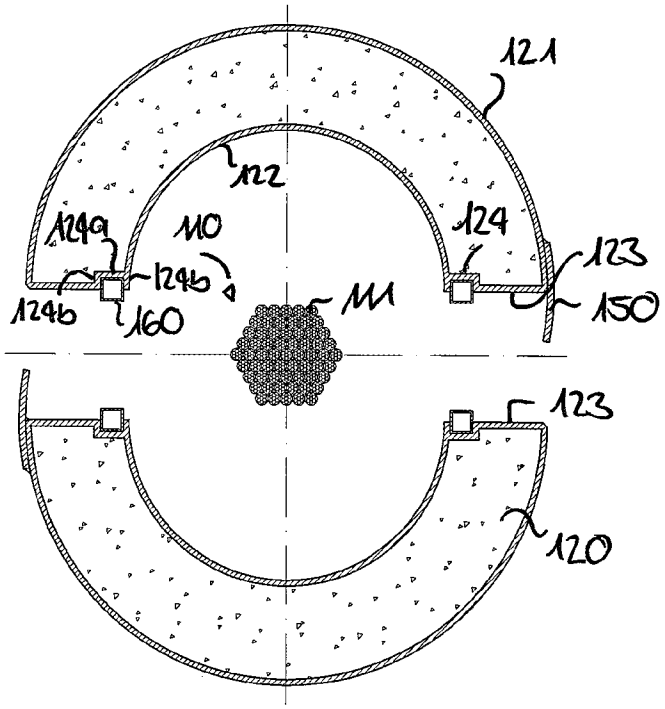
Figure 4A:
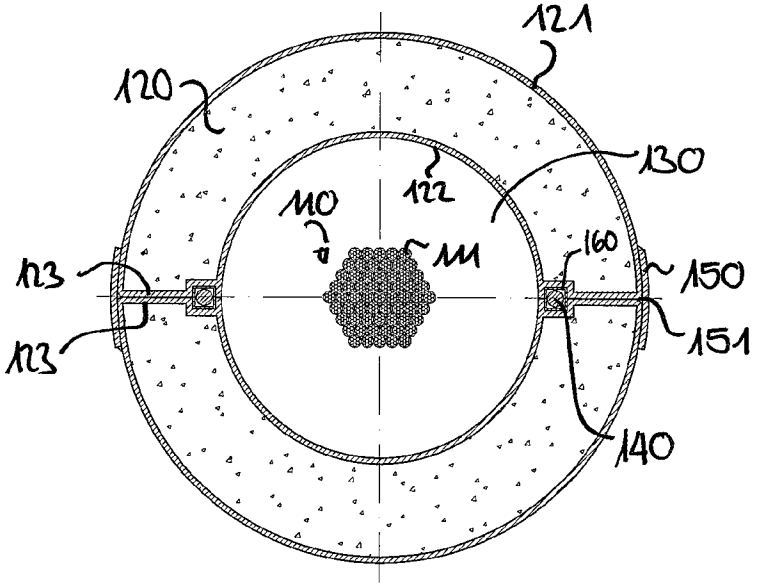
Figure 5:
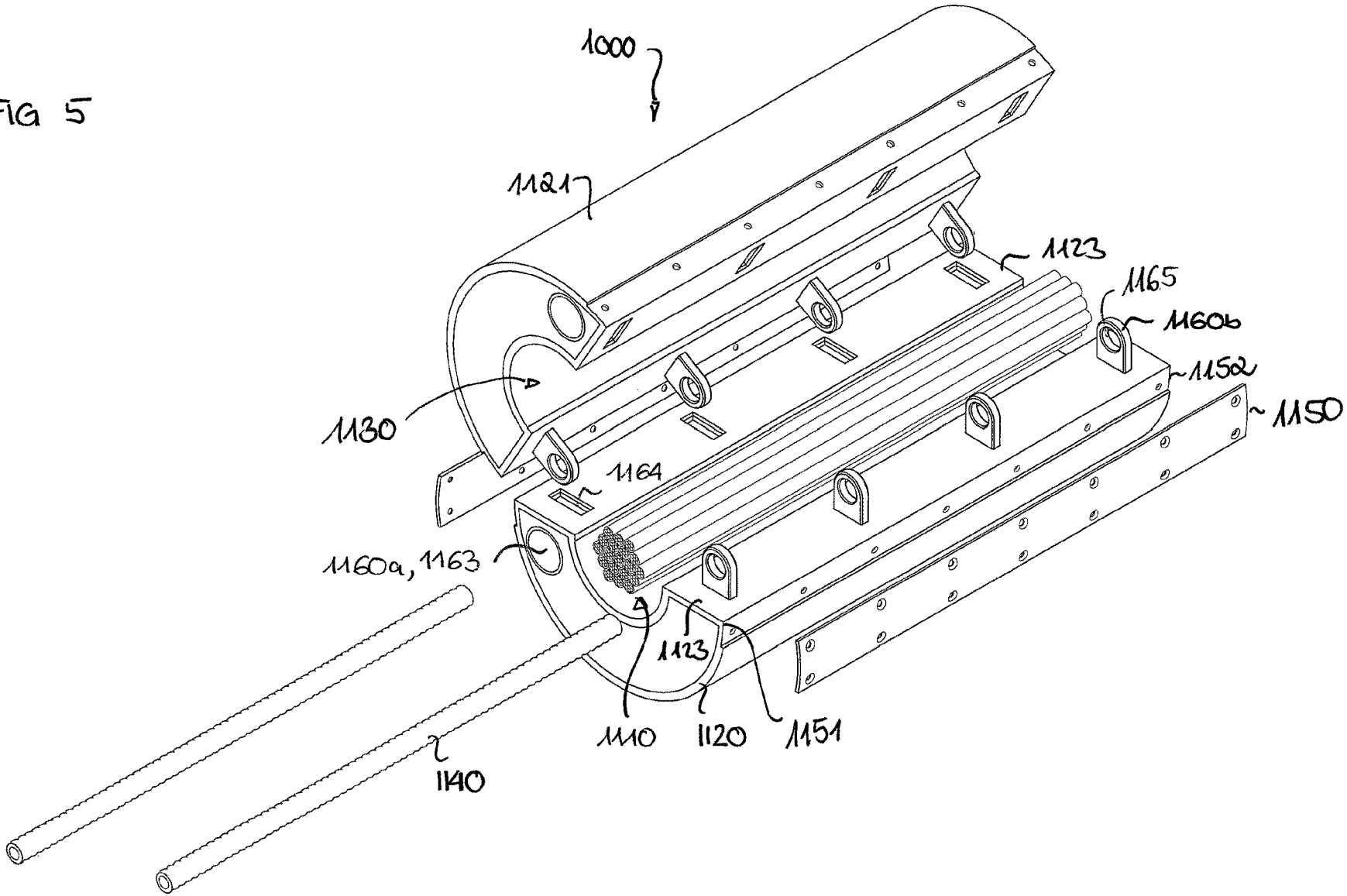
Figure 6B:
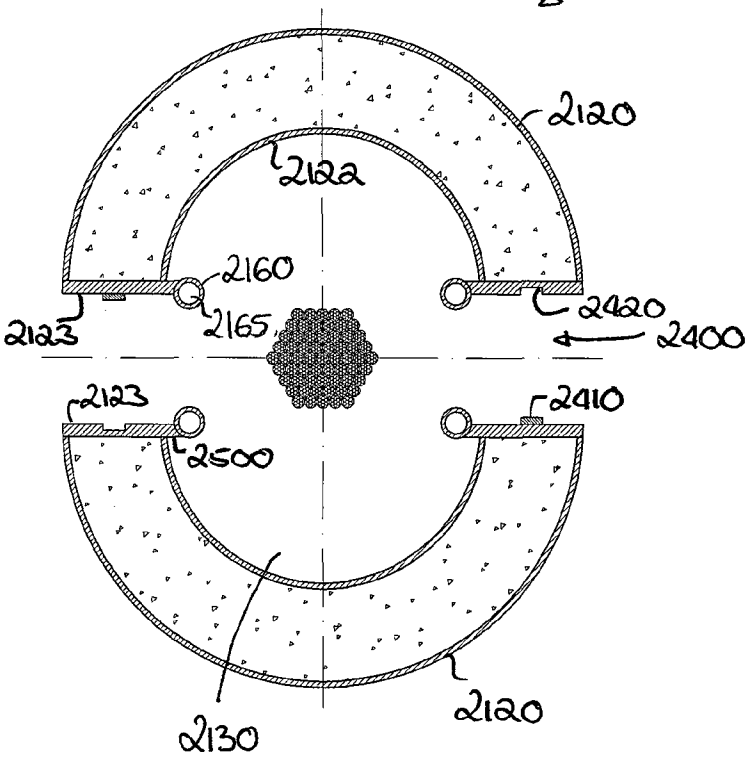
Figure 6A:
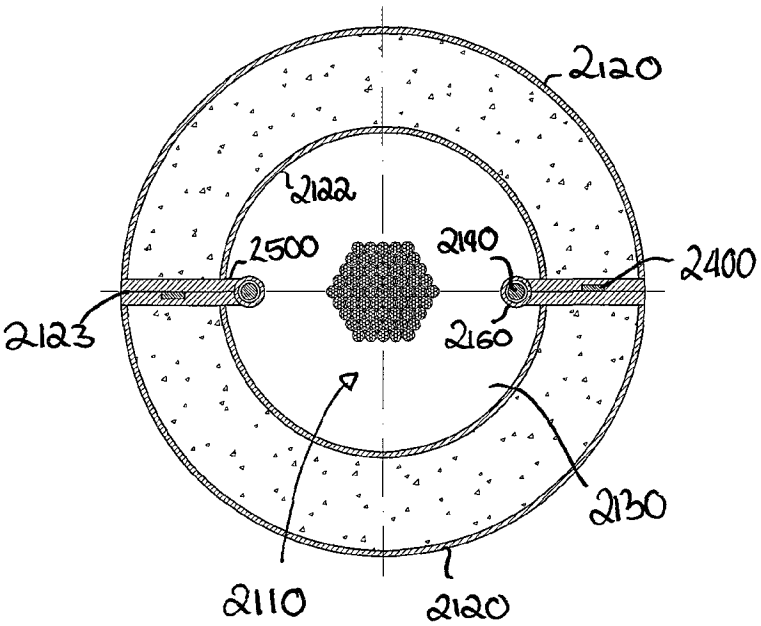

The invention is explained in more detail below using the attached drawings and embodiment examples, as follows:

FIG. 1 a longitudinal view of a tension member protection system according to the invention, FIG. 2 an exploded view of a tension member protection system according to the invention, FIG. 3 a view of an opened tension member protection system, FIG. 4A a section through the tension member protection system, FIG. 4B a section through the tension member protection system with a spatial separation between the contact surfaces of the two shell elements, FIG. 5 a second embodiment of the tension member protection system, FIG. 6A a section through a third embodiment of the tension member protection system, and FIG. 6B a section through the third embodiment of the tension member protection system, with a spatial separation between the contact surfaces of the two shell elements.

In FIG. 1, a tension member protection system is generally designated by the number 100. The tension member protection system 100 is designed and intended to protect a tension member 110 arranged between two sections of a structure. In particular, it can provide protection against heat, impact or, more generally, mechanical damage.

The tension member 110 consists of multiple strands 111 and can be used, for example, to transfer the loads of deck slabs of cable-stayed bridges to the pylon(s). However, any other function/structure is also conceivable for which or in which tension members can be used.

The tension member protection system 100 furthermore comprises two or more shell elements 120 which are arranged around the tension member 110 and thus form a circular cylinder with an internal cavity 130. The cavity 130 of the circular cylinder formed by the shell elements 120 serves to accommodate the tension member 110. To form this cavity 130, the contact surfaces 123 of the shell elements 120 lie against each other.

The shell elements 120 are made of a metallic material, but can also be made of any other material that meets the requirements of the invention.

As can be seen from FIG. 1, the tension member protection system 100 can comprise two shell elements 120. In this case, each shell element 120 can be designed in such a way that it surrounds the tension member 110 through 180° of its circumference. In this case, both shell elements 120 have the same cross-section. Alternatively, the two shell elements 120 can have different cross-sections. If the tension member 110 is to be surrounded by more than two shell elements 120, these can either be designed as shell elements 120 of the same size or can have differently sized cross-sections. Naturally the shell elements 120 should always be of equal length to prevent the tension member 110 from being exposed.

The shell elements 120 can be designed as solid elements or as hollow elements. In either case, each of the shell elements 120 has an outer surface or outer circumferential surface 121, an inner circumferential surface 122 and two contact surfaces 123.

Furthermore, the shell elements 120 have an indentation 124 on the contact surfaces 123 which extends along the entire shell element 120 and which, after the shell elements 120 have been joined to form a circular cylinder, serves to accommodate a rod-shaped element 140. The indentation 124 can in particular be square or rectangular, so as to accommodate a rod-shaped element 140 with square, rectangular or round cross-section. However, the indentation can also be round, to accommodate a rod-shaped element that is round or square or of any other shape that meets the requirements of the invention. If the indentation 124 is square, as is the case in FIGS. 1 to 4, the indentation 124 has a face 124*a* which runs parallel to the contact surface 123 and two side faces 124*b*, whereby the side face 124*b* which lies nearer to the cavity 130 can be integrally formed with the inner circumferential surface 122 of the shell element 120.

Each shell element 120 has an indentation 124 on each contact surface 123. There can however be more indentations 124 on each of the contact surfaces 123 or on one or more of a number of contact surfaces 123. The indentation can preferably be located on the side of the contact surface 123 which is adjacent to the inner circumferential surface of the shell element 120. However, the indentation 124 may be located in any other position on the contact surface 123.

Once the shell elements 120 are joined together and the contact surfaces 123 lie against each other, the indentations of two adjacent contact surfaces 123 create a cavity 125 of square or rectangular shape, if they are so designed, or of circular or cylindrical shape if they are of circular design, for example.

As previously mentioned, the cavities 125 formed by the indentations 124 serve to receive a rod-shaped element 140. Such an element is shown in an exploded view in FIGS. 2 and 3, and inserted in the cavity 125 in FIG. 4A and FIG. 4B. The rod-shaped element 140 can be made of a metallic material, but can also be made of any other material that meets the requirements of the invention. It can be smooth or ribbed or similar. Furthermore, the rod-shaped element 140 can be shorter than the shell elements 120. Where several tension member protection systems 100 are applied in a row to the tension member 110, the rod-shaped element 140 may be longer than the individual shell elements 120 of a tension member protection system 100 and may also be as long as the length of the overall arrangement of the tension member protection system 100.

In addition, the tension member protection system 100 comprises a cover plate 150 which covers the joints 151 between the two abutting contact surfaces 123 of the shell elements 120 and is fastened to at least one of the two shell elements 120. To conceal the circumferential position at which the joints of the shell elements 120 are actually located, at least one further cover plate 150 can also be provided which is fastened to the outer circumferential surface 121 of one of the shell elements 120. The cover plates 150 can be fastened to the outer circumferential surface 121 of the shell element 120 by means of bolts. However, any other expedient fastening means may be chosen.

The cover plates 150 can be made of a metallic material, but can also be made of any other material that meets the requirements of the invention. Furthermore, the cover plates 150 can be curved, preferably corresponding to the curvature of the outer circumferential surface 121.

The tension member protection system 100 also comprises joining sleeves 160. These are joining means for joining the shell elements 120. Each joining sleeve is hollow and has a through-hole 165 and end faces 162. The joining sleeves 160 are arranged on the shell elements 120 in the cavities 125 formed by the indentations 124. The joining sleeves 160 therefore have a cross-section that is complementary to the cavities 125. For example, if the cavities 125 are square shaped, the joining sleeves 160 have a corresponding square cross-section.

Regardless of the cross-sectional shape of the joining sleeves 160 and the rod-shaped element 140, it is advantageous if the cross-section of the through-hole 165 of the joining sleeves 160 has internal dimensions which are larger than the (largest) external dimensions of the cross-section of the rod-shaped element 140. In particular, the diameter of the rod-shaped element 140, if it has a circular cross-section, should be smaller than the smallest internal side length of the through-hole 165 of the joining sleeves 160 or than the diameter at the inner circumference of the through-hole 165 of the joining sleeves 160. Furthermore, the dimension of the largest side length of the rod-shaped element 140, if it has a rectangular (or square) cross-section, should be smaller than the smallest internal side length of the through-hole 165 of the joining sleeves 160 or than the diameter at the inner circumference of the through-hole 165 of the joining sleeves 160.

Each joining sleeve 160 is attached to the surface 124*a* in an indentation 124 which runs parallel to the contact surface 123, via suitable fastening means or methods and is thus assigned to a shell element 120. Naturally, the joining sleeves 160 can also be joined to one or both side faces 124*b* or be designed integrally with the respective indentation 124. If the indentation 124 is circular, the joining sleeve 160 is attached to the whole of the indentation 124.

A plurality of joining sleeves 160 is arranged in each cavity 125, one half of the plurality of joining sleeves 160 being attached to one shell element 120 and the other half of the plurality of joining sleeves 160 being attached to the other shell element 120. The joining sleeves 160 are preferably fastened to one shell element 120 and the other shell element 120 in an alternating sequence. The joining sleeves 160 are attached in such a way that, when the contact surfaces of the shell elements 120 lie against each other, they engage with each other so that the through-holes 165 of the joining sleeves 160 completely overlap in the longitudinal direction of the tension member protection system 100 and the end faces 162 of the joining sleeves 160 lie against each other. Alternatively, the joining sleeves can be attached and assigned to the shell elements in a different sequence, provided that the joining of joining sleeves 160 arranged in this way by means of the rod-shaped element 140 leads to a positive connection of the two shell elements 120. For example, two joining sleeves 160 can be attached to one shell element 120 and, proceeding in the longitudinal direction of the tension member protection system 100, one joining sleeve 160 can then be attached to the other shell element 120, and so on.

Alternatively, certain spaces may be present between the end faces 162 of the joining sleeves 160, provided that a joining of joining sleeves 160 arranged in this way by means of the rod-shaped element 140 leads to a positive connection of the two shell elements 120.

The joining sleeves 160 are made of a metallic material, but can also be made of any other suitable material. To simplify the manufacturing process, the joining sleeves 160 can be of the same length. The end joining sleeves 160 in the longitudinal direction of the tension member 110 may however be of a different length. Alternatively, the joining sleeves 160 can be of different lengths.

To join the shell elements 120, they are brought into contact at the contact surfaces 123 so that the joining sleeves engage with each other and the through-holes 165 are aligned with each other. The rod-shaped elements 140 are then inserted into the through-holes 165 of the joining sleeves 160 until they are fully inserted in the joining sleeves 160.

To prevent the rod-shaped elements 140 from falling out of their own accord, a base plate (not shown) can be attached to the lower end of the tension member protection system 100. When assembled, a cover plate (not shown) can also be attached to the upper end of the tension member protection system 100.

Furthermore, to protect the tension member protection system 100, a housing (not shown) can be mounted over it. The base plate, the cover plate and the housing can be made of sheet steel. Alternatively, the housing can be made of any other suitable material.

An alternative, second embodiment can also be conceived whereby part 1160*a* of the plurality of joining sleeves 1160 is designed integrally with the shell element 1120, as shown in FIG. 5. In relation to this embodiment of the invention, the reference numbers are increased by 1000 and only the differences compared with the first embodiment are indicated. In this case the joining sleeves 1160*a* are designed as a circular through-hole 1163 in the shell element 1120. This through-hole 1163 extends from the lower end to the upper end of the shell element 1120. In addition, the shell element has openings 1164 on one contact surface 1123, beneath which the through-hole 1163 is located.

Furthermore, in this embodiment the shell elements 1120 have joining sleeves 1160*b* protruding from the other contact surface 1123, which are fastened thereon by welding, soldering, gluing or an alternative fastening method. These joining sleeves 1160*b* are circular in the cross-sectional portion further away from the contact surface 1123, a web being arranged in the joining sleeves 1160*b* between the contact surface 1123 and the circular section. A through-hole 1165 is located in the circular section of the joining sleeves 1160*b*, through which the rod-shaped element 1140 is finally passed after the contact surfaces 1123 have been joined together.

The openings 1164 are designed and arranged so that the joining sleeves 1160*b* can pass through the openings 1164 when the shell elements 1120 are joined together. When the contact surfaces 1123 of two shell elements 1120 lie against each other, the respective joining sleeve 1160*b* is completely accommodated in the opening 1164 and in the through-hole 1163 underneath. For this purpose, the openings 1164 should be arranged in the longitudinal direction of the contact surface 1123 at the same distances from the lower (or upper)

end section of the shell element 1120 and from the outer circumferential surface 1121 as the joining sleeves 1160*b*.

Therefore, each joining sleeve 1160*b* should be so designed that the radius of the circular portion of the joining sleeve 1160*b* essentially corresponds to the radius of the through-hole 1163 and the maximum linear expansion between the contact surface 1123 and the opposite inner circumferential surface corresponds to that of the through hole 1163.

Furthermore, the extent of the joining sleeves 1160*b* in the longitudinal direction of the shell elements 1120 is small in comparison to their height.

The joining sleeves 1160*b* are arranged at equal distances on the contact surfaces 1123. "Equal" in this context means that the joining sleeves 1160*b* are arranged at equal distances in the longitudinal direction of the respective contact surface 1123. However, it also means that the joining sleeves 1160*b* are fastened to one contact surface 1123 and to another contact surface 1123 at the same distances from the base plate and cover plate.

The joining sleeves 1160*b* can have chamfered edges. The openings 1164 can also be chamfered on the side facing the contact surface 1123.

For this embodiment, the shell element 1120 should be designed as a hollow body, otherwise the openings 1164 should have a passage to the through hole 1163 which allows the joining sleeves 1160*b* to pass through.

In this embodiment, the cover plate(s) 1150 can be fitted in a recess 1152 of the outer circumferential surface 1121. This recess extends above and below the joint 1151.

In a third embodiment of the invention, the reference numbers are increased by 2000 and only the differences compared with the first embodiment are described. In this third embodiment of a tension member protection system 2100, the joining sleeves 2160 are arranged in the cavity 2130. As shown in FIG. 6, the joining sleeves 2160 are preferably arranged with an intermediate web 2500 on an inner circumferential surface 2122 of the two shell elements 2120. Alternatively, the joining sleeves 2160 can be arranged directly adjacent to the inner circumferential surface 2122 of the two shell elements 2120.

The joining sleeves 2160 are circular in FIG. 6 with a through-hole 2165; naturally they can also be designed with any other shape, particularly rectangular or square.

FIG. 6A shows the shell elements 2120 in an assembled state, the rod-shaped elements 2140 being inserted into the joining sleeves 2160.

Optionally, in this third embodiment of the invention, a coupling device 2400 can be arranged in the contact surfaces 2123 of at least two shell elements 2120, which lie against each another in the cavity 2130 forming state, which couples the contact surfaces 2123 of at least two shell elements 2120 with each other. This coupling device 2400 may comprise a projection 2410 on one of the two contact surfaces 2123 which lie against each other in the cavity 2130 forming state and a depression 2420 in the other. The projection 2120 and the depression 2420 are designed so that they interlock when the shell elements 2120 form the cavity 2130.

The coupling device 2400 can be arranged along the entire length of the contact surfaces 2123 so that it forms a continuous strip. Alternatively, multiple coupling devices 2400 can be arranged over the entire length of the contact surfaces 2123, so that the individual coupling devices 2400 act at those points. The coupling devices 2400 can have the same or alternatively different lengths. There may be equal or different distances between the coupling devices 2400.

The invention claimed is:

1. A tension member protection system for protecting a tension member arranged between two sections of a structure, comprising:

two or more shell elements arranged circumferentially around the tension member which together surround a cavity configured to receive the tension member, wherein the two or more shell elements are hollow elements, each shell element of the two or more shell elements has an outer surface, an inner circumferential surface, and two contact surfaces, and each shell element of the two or more shell elements is made of a metallic material;

a plurality of joining sleeves, each joining sleeve of the plurality of joining sleeves being associated with one of the two shell elements and having a respective through-hole extending in a longitudinal direction of the tension member protection system, the plurality of joining sleeves being configured and being arranged on the two or more shell elements in such a way that, in a cavity forming state in which respective contact surfaces of the two or more shell elements lie against each other to form the cavity, respective joining sleeves of the plurality of joining sleeves interlock, and the through-holes only overlap completely when the two or more shell elements lie with their contact surfaces against other; and a rod-shaped element configured to be passed through the through-holes of the respective joining sleeves of the plurality of joining sleeves when the two or more shell elements are in the cavity forming state with the respective joining sleeves interlocked.

2. The tension member protection system according to claim 1, further comprising a cover plate covering a joint between the two or more shell elements lying against each other and fastened to at least one of the two or more shell elements.

3. The tension member protection system according to claim 2, further comprising at least one further cover plate fastened to an outer surface of one of the two or more shell elements.

4. The tension member protection system according to claim 1, wherein the rod-shaped element is equal in length to the tension member protection system.

5. The tension member protection system according to claim 1, wherein respective joining sleeves of the plurality joining sleeves assigned to one shell element of the two or more shell elements and respective joining sleeves of the plurality of joining sleeves assigned to another shell element of the two or more shell elements interlock in alternating sequence.

6. The tension member protection system according to claim 1, wherein each of the joining sleeves of the plurality of joining sleeves assigned to the two or more shell elements are of the same length.

7. The tension member protection system according to claim 1, wherein each joining sleeve of the plurality of joining sleeves has a rectangular cross-section.

8. The tension member protection system according to claim 7, wherein the rod-shaped element has a circular cross-section.

9. The tension member protection system according to claim 1, wherein each joining sleeve of the plurality of joining sleeves has internal dimensions in cross section which are larger than external dimensions of the rod-shaped element in cross section.

10. The tension member protection system according to claim 1, wherein each joining sleeve of the plurality of joining sleeves is arranged in a radial section of the two or more shell elements adjoining the cavity.

11. The tension member protection system according to claim 1, wherein the plurality of joining sleeves are arranged in the cavity.

12. The tension member protection system according to claim 1, further comprising a coupling device arranged in the contact surfaces of at least two shell elements of the two or more shell elements, which lie against each another in the cavity forming state, which couples the contact surfaces of at least two shell elements with each other, with the coupling device comprising a positive coupling between projections and depressions that engage with each other.

13. The tension member protection system according to claim 12, wherein at least one shell element of the two or more shell elements has a housing, whose interior accommodates the protection system.

14. The tension member protection system according to claim 1, wherein the rod-shaped element has a circular cross-section.

15. A tension member protection system for protecting a tension member arranged between two sections of a structure, comprising:

two or more shell elements arranged circumferentially around the tension member which together surround a cavity configured to receive the tension member;

a plurality of joining sleeves arranged in the cavity, each joining sleeve of the plurality of joining sleeves being associated with one of the two shell elements and having a respective through-hole extending in a longitudinal direction of the tension member protection system, the plurality of joining sleeves being configured and being arranged on the two or more shell elements in such a way that, in a cavity forming state in which respective contact surfaces of the two or more shell elements lie against each other to form the cavity, respective joining sleeves of the plurality of joining sleeves interlock, and the through-holes only overlap completely when the two or more shell elements lie with their contact surfaces against other; and a rod-shaped element configured to be passed through the through-holes of the respective joining sleeves of the plurality of joining sleeves when the two or more shell elements are in the cavity forming state with the respective joining sleeves interlocked.

* * * * *